US011583715B2

(12) United States Patent
Sova

(10) Patent No.: US 11,583,715 B2
(45) Date of Patent: Feb. 21, 2023

(54) FIRE-EXTINGUISHING DEVICE (VARIANTS), LOCK AND RELEASE DEVICE FOR FIRE-EXTINGUISHING DEVICE (VARIANTS), FORCED ACTIVATION DEVICE FOR LOCK AND RELEASE DEVICE, FIRE-EXTINGUISHING SYSTEM AND FIRE-EXTINGUISHING METHOD

(71) Applicant: Nikolay Vadimovich Sova, Moscow (RU)

(72) Inventor: Nikolay Vadimovich Sova, Gorodskoe poselenie Schelkovo (RU)

( * ) Notice: Subject to any disclaimer, the term of this patent is extended or adjusted under 35 U.S.C. 154(b) by 64 days.

(21) Appl. No.: 16/632,391

(22) PCT Filed: Jul. 20, 2017

(86) PCT No.: PCT/RU2017/000537
§ 371 (c)(1),
(2) Date: Jan. 20, 2020

(87) PCT Pub. No.: WO2019/017805
PCT Pub. Date: Jan. 24, 2019

(65) Prior Publication Data

US 2020/0230453 A1 Jul. 23, 2020

(51) Int. Cl.
*A62C 37/48* (2006.01)
*A62C 37/11* (2006.01)
(Continued)

(52) U.S. Cl.
CPC ..... *A62C 37/48* (2013.01); *A62C 13/62* (2013.01); *A62C 37/11* (2013.01); *A62C 35/023* (2013.01); *A62C 99/0027* (2013.01)

(58) Field of Classification Search
CPC ..... A62C 13/62; A62C 13/74; A62C 35/023; A62C 35/10; A62C 35/11; A62C 35/13;
(Continued)

(56) References Cited

U.S. PATENT DOCUMENTS 3,012,694 A * 12/1961 Johnston ..... A61M 15/00 222/5
4,272,236 A 6/1981 Rees et al.
(Continued)

FOREIGN PATENT DOCUMENTS

RU 14391 U1 7/2000
RU 2347597 C1 2/2009
(Continued)

OTHER PUBLICATIONS

PCT/RU2017/000537, International Preliminary Report on Patentability (translation).
(Continued)

*Primary Examiner* — Darren W Gorman
(74) *Attorney, Agent, or Firm* — Chad Peterson

(57) ABSTRACT

The proposed technical solution relates to fire prevention equipment and can be used in industrial and civilian properties, including with an increased risk of fire, for locating hot spots, and also for efficiently extinguishing fires in facilities using automatic fire-extinguishing systems. The technical problem addressed by the claimed invention is to produce a fire-extinguishing device which does not have the drawbacks mentioned and has increased reliability, efficiency and manufacturability. The technical result of the claimed invention consists in elimination of the drawbacks of the prior art, in an increase in the reliability and manufacturability of a fire-extinguishing device and thus in an increase in the fire-extinguishing efficiency overall.

18 Claims, 2 Drawing Sheets

(51) Int. Cl.
*A62C 13/62* (2006.01)
*A62C 35/02* (2006.01)
*A62C 99/00* (2010.01)

(58) Field of Classification Search
CPC ..... A62C 37/11; A62C 37/14; A62C 37/48; A62C 99/0018; A62C 99/0027
See application file for complete search history.

(56) References Cited

U.S. PATENT DOCUMENTS

| | | | | | |
|---|---|---|---|---|---|
| 5,551,517 | A * | 9/1996 | Arsenault | A62C 37/12 | 169/26 |
| 5,615,743 | A * | 4/1997 | Matsumoto | A62C 13/62 | 169/74 |
| 5,704,428 | A * | 1/1998 | Asano | A62C 13/62 | 169/74 |
| 6,138,768 | A * | 10/2000 | Fujiki | A62C 13/62 | 169/30 |
| 7,419,010 | B2 * | 9/2008 | Yoshida | A62C 13/62 | 141/19 |
| 8,448,716 | B2 * | 5/2013 | Yoshida | A62C 13/62 | 169/72 |
| 8,651,194 | B2 * | 2/2014 | Yoshida | A62C 13/76 | 169/72 |
| 8,651,195 | B2 * | 2/2014 | Yoshida | A62C 99/0018 | 169/72 |
| 2013/0014964 | A1 * | 1/2013 | Yoshida | A62C 99/0018 | 169/89 |
| 2017/0036048 | A1 * | 2/2017 | Klug | A62C 37/11 | |

FOREIGN PATENT DOCUMENTS

| | | | | |
|---|---|---|---|---|
| RU | 2631520 | C1 | 9/2017 | |
| SU | 671815 | A1 | 7/1979 | |
| WO | WO-2015057107 | A1 * | 4/2015 | A62C 37/48 |
| WO | WO2015161955 | A1 | 10/2015 | |

OTHER PUBLICATIONS

PCT/RU2017/000537, Written Opinion of the International Searching Authority (translation).
PCT/RU2017/000537, International Search Report (translation).
RU2017135603/12, Search Report (machine translation).

* cited by examiner

FIRE-EXTINGUISHING DEVICE (VARIANTS), LOCK AND RELEASE DEVICE FOR FIRE-EXTINGUISHING DEVICE (VARIANTS), FORCED ACTIVATION DEVICE FOR LOCK AND RELEASE DEVICE, FIRE-EXTINGUISHING SYSTEM AND FIRE-EXTINGUISHING METHOD

FIELD OF INVENTION

The suggested technical solution is relating to fire-extinguishing equipment and may be used in industrial and civilian facilities, including, in those with increased fire hazard, in order to localize fire sources, as well for effective fire extinguishing in the rooms with deployment of automatic fire-extinguishing systems.

BACKGROUND OF INVENTION

There is a known fire-extinguishing device as described in application US2017036048 (A1), published on 9 Feb. 2017 on 15 sheets. The known fire-extinguishing device consists of a cylinder and a lock and release device which includes a thermal lock being destructed once the temperature limit is reached. This activates a spring-loaded push-bar which is performed as a hollow needle; it breaks through cylinder's membrane and releases gas fire extinguishing agent (GFEA) which is discharged under pressure through spray element's openings. In an optional performance, the lock and release device includes an electronic device of forced actuation; and the thermal lock includes conductive coating which allows heating of liquid inside the thermal lock when supplying voltage to the forced actuation device. Thereby, this results in lock destruction and release of push-bar spring.

Disadvantages of the specified solution are that in the lock and release device, the push-bar sleeve is connected with the spray element through only one slot. This results in the fact that in the moment of movement the push bar may be positioned noncoaxially towards the axis of exhaust opening, which in its turn will result in its jamming or in breaking-off the closure under angle, by the push bar. Respectively, this may result both in total failure of the device and in its wrong actuation, which will reduce efficiency of fire extinction.

Moreover, push-bar sleeve is connected with the spray element with a pin through a slot; whereas, the pin is performed with a uniform cross section along its length. This, respectively, in case of device actuation, results in ineffective release of GFEA.

Other disadvantages of the specified device include the fact that the lock and release device is connected with the cylinder directly; whereas, the closure element (membrane) is positioned immediately in the lock and release device. This, respectively, reduces processability of the device and does not allow assembling in the place of installation.

Finally, in case of the device with a forced-actuation device in its assembly, among disadvantages there are the following: that the actuation device is supposed to be mounted in the upper part of spray-element cap, which, respectively, also decreases processability of the device in general, because in this case, an additional working hole is required. Performance of such forced-actuation device is also questioned, so far as it requires to have a direct current supply in the system. Such direct current supply must ensure sufficient operating period in order to cause actuation of the thermal lock.

DISCLOSURE OF INVENTION

The technical problem to be solved by the declared invention is making a device for fire-extinction which does not have the above specified disadvantages, possesses higher reliability, performance and processability.

The technical result of the declared invention is removal of prototype's disadvantages, increase in reliability and processability of the design of fire-extinguishing device and, as a consequence, an increase in fire extinction performance in general.

Technical result is reached for the account of providing the fire-extinguishing device, which is a container filled-up with gas fire-extinguishing agent, with the locking nut; whereas, the locking nut is connected with the container's outlet and includes a closure element which retains the fire-extinguishing agent inside the container under pressure; and a lock and release device, whereas, the lock and release device consists of push-bar casing which is connected with the help of the lock nut from one side; from the other side it is connected with the spray element; push-bar casing is a hollow bar with a fastening hollow foundation, in the bottom of the bar and partially in the fastening foundation there are symmetrically made at least two longitudinal slots, inside the bar there is a springed tubular push-bar—a hollow needle on a basis. The basis contains at least two symmetrical openings which diameter allows to reliably fasten the tubular push-bar in springed state with the help of a pin through the specified above slots, whereas the pin is made with variable section; whereas the section of the pin in its middle part, which in fixed state is positioned crosswise of the outlet of tubular push-bar, is made in less dimension than at the edges of the pin; the spray element is a hollow cylindrical cap which is threaded on push-bar casing and is fastened through at least two symmetrical openings in its bottom part with the help of the above said pins through the above said slots; in the top part of the spray element there is a hollow to position the thermosensitive element, in the sides of the spray element's top part there are at least two symmetrical spraying openings, whereas, the locking thermosensitive element forms up a retainer for the specified rod and prevents release of the spring, whereas destruction of the thermosensitive element causes release of the spring; whereas, release of the spring results in transition of the specified pin along the specified slots towards the locknut; whereas, the specified tubular push-bar is placed in such a manner that in transition of the pin it moves towards the locknut in order to break off the specified locking element and to release the fire-extinguishing agent.

BRIEF DESCRIPTION OF DRAWINGS

Illustrated variants of realization of this invention are described further herein in detail with reference to the attached drawings. The drawings are incorporated herein by reference and on which.

EMBODIMENTS OF INVENTION

Figure 1:
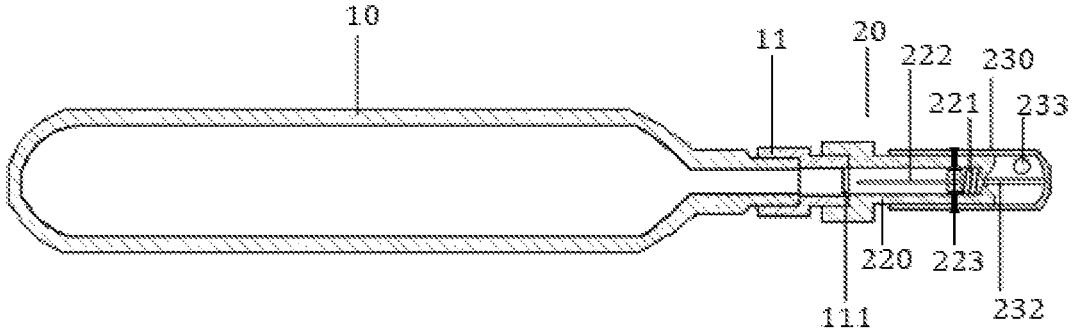
FIG. 1 demonstrates a blank drawing of the applied device for fire extinction.

Further, find variants of realization of this invention which reveal examples of its realization in certain variants of performance. Nevertheless, the description itself is not intended to limit the scope of rights conferred by this patent. Rather, one should be based on the fact that the claimed invention may as well be realized in other ways in such a manner so to include differing elements and specifications or combinations of elements and specifications, which are the same as the elements and specifications as described herein, in combination with other existing and future technologies.

In the preferable variant of realization there is provided the fire-extinguishing device, which is a container filled-up with gas fire-extinguishing agent, with the locking nut; whereas, the locking nut is connected with the container's outlet and includes a closure element which retains the fire-extinguishing agent inside the container under pressure; and a lock and release device, whereas, the lock and release device consists of push-bar casing which is connected with the help of the lock nut from one side; from the other side it is connected with the spray element; push-bar casing is a hollow bar with a fastening hollow foundation, in the bottom of the bar and partially in the fastening foundation there are symmetrically made at least two longitudinal slots, inside the bar there is a springed tubular push-bar—a hollow needle on a basis. The basis contains at least two symmetrical openings which diameter allows to reliably fasten the tubular push-bar in springed state with the help of a pin through the specified above slots, whereas the pin is made with variable section; whereas the section of the pin in its middle part, which in fixed state is positioned crosswise of the outlet of tubular push-bar, is made in less dimension than at the edges of the pin; the spray element is a hollow cylindrical cap which is threaded on push-bar casing and is fastened through at least two symmetrical openings, in its bottom part with the help of the above said pins through the above said slots; in the top part of the spray element there is a hollow to position the thermosensitive element, in the sides of the spray element's top part there are at least two symmetrical spraying openings, whereas, the locking thermosensitive element forms up a retainer for the specified rod and prevents release of the spring, whereas destruction of the thermosensitive element causes release of the spring; whereas, release of the spring results in transition of the specified pin along the specified slots towards the locknut; whereas, the specified tubular push-bar is placed in such a manner that in transition of the pin it moves towards the locknut in order to break off the specified locking element and to release the fire-extinguishing agent.

In another preferable variant of realization there is provided the fire-extinguishing device, which is a container filled-up with gas fire-extinguishing agent, with the locking nut; whereas, the locking nut is connected with the container's outlet and includes a closure element which retains the fire-extinguishing agent inside the container under pressure; and a lock and release device, whereas, the lock and release device consists of push-bar casing which is connected with the help of the lock nut from one side; from the other side it is connected with the spray element; push-bar casing is a hollow bar with a fastening hollow foundation, in the bottom of the bar and partially in the fastening foundation there are symmetrically made at least two longitudinal slots, inside the bar there is a springed tubular push-bar—a hollow needle on a basis. The basis contains at least two symmetrical openings which diameter allows to reliably fasten the tubular push-bar in springed state with the help of a pin through the specified above slots, whereas the pin is made with variable section; whereas the section of the pin in its middle part, which in fixed state is positioned crosswise of the outlet of tubular push-bar, is made in less dimension than at the edges of the pin; the spray element is a hollow cylindrical cap which is threaded on push-bar casing and is fastened through at least two symmetrical openings, in its bottom part with the help of the above said pins through the above said slots; in the top part of the spray element there is a hollow to position the thermosensitive element, in the sides of the spray element's top part there are at least two symmetrical spraying openings, one of the openings is performed with the feature to add devices of forced actuation, whereas, the locking thermosensitive element forms up a retainer for the specified rod and prevents release of the spring, whereas destruction of the thermosensitive element causes release of the spring; whereas, release of the spring results in transition of the specified pin along the specified slots towards the locknut; whereas, the specified tubular push-bar is placed in such a manner that in transition of the pin it moves towards the locknut in order to break off the specified locking element and to release the fire-extinguishing agent.

In another preferable variant of realization of this invention there is provided a lock and release device for the fire-extinguishing device, which is a push-bar casing, which is performed with a feature of connection from one side with the help of a locknut with locking element, whereas from the other side it is connected with the spray element; push-bar casing is a hollow bar with a fastening hollow foundation, in the bottom of the bar and partially in the fastening foundation there are symmetrically made at least two longitudinal slots, inside the bar there is a springed tubular push-bar—a hollow needle on a basis. The basis contains at least two symmetrical openings which diameter allows to reliably fasten the tubular push-bar in springed state with the help of a pin through the specified above slots, whereas the pin is made with variable section; whereas the section of the pin in its middle part, which in fixed state is positioned crosswise of the outlet of tubular push-bar, is made in less dimension than at the edges of the pin; the spray element is a hollow cylindrical cap which is threaded on push-bar casing and is fastened through at least two symmetrical openings, in its bottom part with the help of the above said pin through the above said slots; in the top part of the spray element there is a hollow to position the thermosensitive element, in the sides of the spray element's top part there are at least two symmetrical spraying openings, whereas, the locking thermosensitive element forms up a retainer for the specified rod and prevents release of the spring, whereas destruction of the thermosensitive element causes release of the spring; whereas, release of the spring results in transition of the specified pin along the specified slots towards the locknut; whereas, the specified tubular push-bar is placed in such a manner that in transition of the pin it moves towards the locknut in order to break off the specified locking element and to release the fire-extinguishing agent.

In another preferable variant of realization of this invention there is provided a lock and release device for the fire-extinguishing device, which is a push-bar casing, which is performed with a feature of connection from one side with the help of a locknut with locking element, whereas from the other side it is connected with the spray element; push-bar casing is a hollow bar with a fastening hollow foundation, in the bottom of the bar and partially in the fastening foundation there are symmetrically made at least two longitudinal slots, inside the bar there is a springed tubular push-bar—a hollow needle on a basis. The basis contains at least two symmetrical openings which diameter allows to reliably fasten the tubular push-bar in springed state with the help of a pin through the specified above slots, whereas the pin is made with variable section; whereas the section of the pin in its middle part, which in fixed state is positioned crosswise of the outlet of tubular push-bar, is made in less dimension than at the edges of the pin; the spray element is a hollow cylindrical cap which is threaded on push-bar casing and is fastened through at least two symmetrical openings, in its bottom part with the help of the above said pin through the above said slots; in the top part of the spray element there is a hollow to position the thermosensitive element, in the sides of the spray element's top part there are at least two symmetrical spraying openings, whereas, one of the openings is performed with the feature to connect forced-actuation devices; whereas, the locking thermosensitive element forms up a retainer for the specified rod and prevents release of the spring, whereas destruction of the thermosensitive element causes release of the spring; whereas, release of the spring results in transition of the specified pin along the specified slots towards the locknut; whereas, the specified tubular push-bar is placed in such a manner that in transition of the pin it moves towards the locknut in order to break off the specified locking element and to release the fire-extinguishing agent.

In another preferable variant of realization of this invention there is provided a forced-actuation device which includes a fixed impact rod as well as an impact rod release tool, which is performed with the feature of connection through sprayer opening of the lock and release device by the fourth preferable variant of realization of this invention, to the lock and release device so that the impact rod is directed towards the thermosensitive element, whereas the forced-actuation device is performed with the feature of release of the impact rod after receiving the control signal from the control device.

In another preferable variant of realization of this invention there is provided the fire-extinguishing system, which contains at least one fire-extinguishing device by the second preferable variant of this invention realization with forced-actuation device connected to its lock and release device; as well as a control device performed with the feature of transfer of the control signal to the specified forced-actuation device.

In another preferable variant of realization of this invention there is provided the fire extinction method, in which the fire-extinguishing device is positioned in the room being protected, by the second preferable variant of this invention realization with forced-actuation device connected to its lock and release device. Also, once the ignition source is detected or in order to prevent it, the control signal is supplied to the specified forced-actuation device with the help of the control device.

In a certain variant of realization of this invention, the length of slots is ensured to be less than the length of the locking thermosensitive element. In another certain variant of realization of this invention, there is provided a tip of the above specified needle of the tubular push-bar. The tip is equipped with an additional side hole. In another certain variant of realization of this invention, there is provided the thermosensitive element which is a thermal lock. In another certain variant of realization of this invention, there is provided the thermal lock with the actuation temperature within 57 to 79+/−3 degrees of Celsius. In another certain variant of realization of this invention, there is provided the closure element which is a steel membrane. In another certain variant of realization of this invention, there is provided the specified membrane, performed in terms of thickness from at least 0.2 to 1 mm maximum. In another certain variant of realization of this invention, there is provided the container volume from 0.08 to 0.67 l. In another certain variant of realization of this invention, there is provided the quantity of the fire-extinguishing agent in the specified container from 60 to 500 g. In another certain variant of realization of this invention, there is provided a container with length ranging from 210 to 440 mm and width ranging from 35 to 60 mm. In another certain variant of realization of this invention, there is provided a sprayer in which top part, from sides there are at least three openings which are positioned under the angle of 120 degrees. In another certain variant of realization of this invention, there is provided a sprayer in which top part, from sides there are at least four openings which are positioned under the angle of 90 degrees. In another certain variant of realization of this invention, there is provided such positioning of the forced-actuation device, in which the impact rod is positioned at the distance of 0 to 7 mm from the thermosensitive element.

Figure 3:
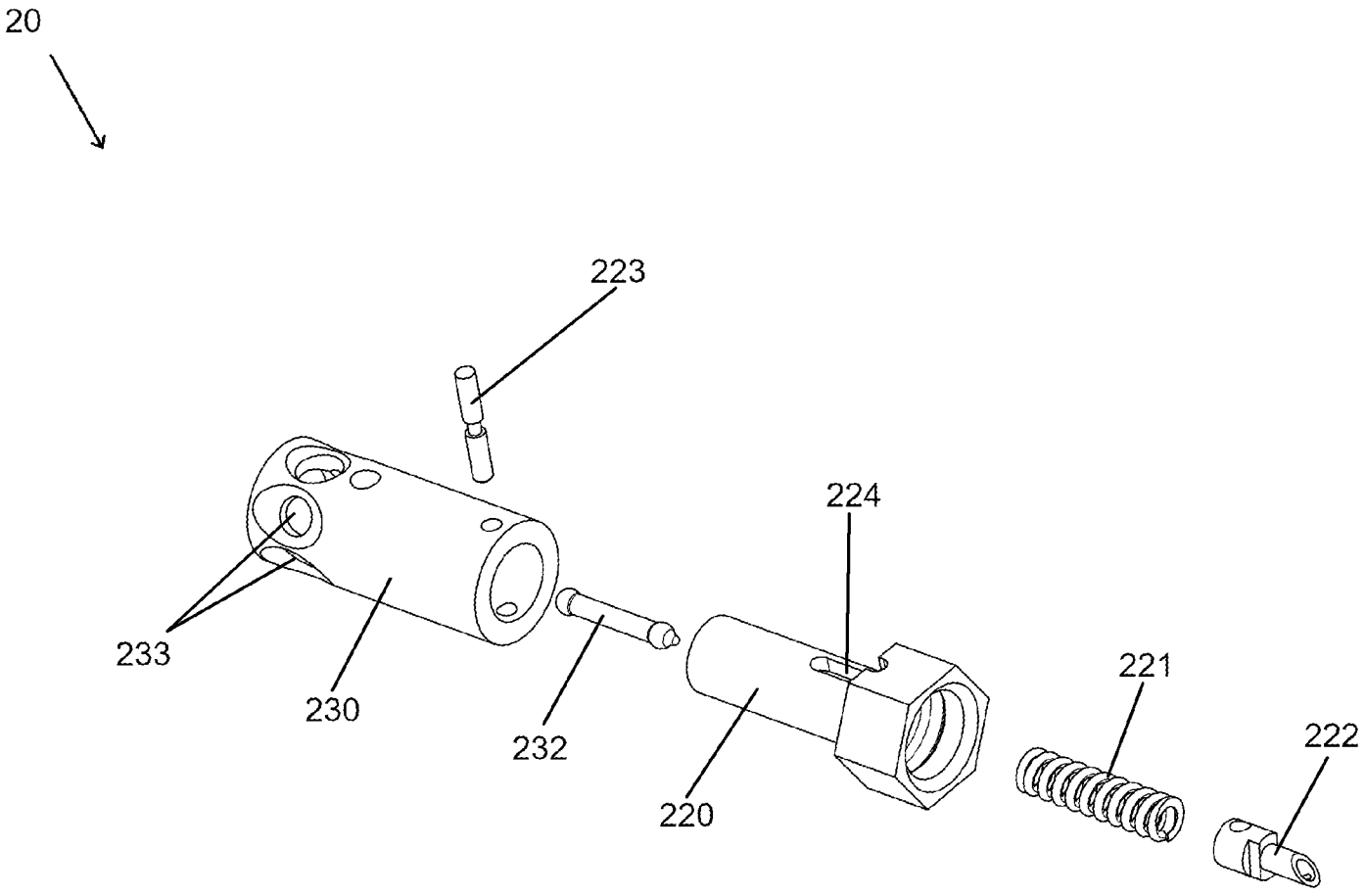
FIG. 3 illustrates an exploded view of a lock and release device.

FIGS. 1 and 3 illustrate the applied device for fire extinction. As FIG. 1 shows, the fire-extinguishing device is a container 10 filled-up with gas fire-extinguishing agent, with the locking nut 11; whereas, the locking nut 11 is connected with the container's outlet 10 and includes a closure element 111, which retains the fire-extinguishing agent inside the container 10 under pressure; and a lock and release device 20, whereas, the lock and release device 20 consists of push-bar casing 220, which is connected with the help of the lock nut 11 from one side; from the other side it is connected with the spray element 230; push-bar casing 220 is a hollow bar with a fastening hollow foundation, in the bottom of the bar and partially in the fastening foundation there are symmetrically made at least two longitudinal slots 224, inside the bar there is a springed 221 tubular push-bar 222—a hollow needle on a basis. The basis contains at least two symmetrical openings (not shown on the figure) which diameter allows to reliably fasten the tubular push-bar in springed state with the help of a pin 223 through the specified above slots, whereas the pin 223 is made with variable section; whereas the section of the pin 223 in its middle part, which in fixed state is positioned crosswise of the outlet of tubular push-bar, is made in less dimension than at the edges of the pin 223; the spray element 230 is a hollow cylindrical cap which is threaded on push-bar casing and is fastened through at least two symmetrical openings (not shown on the figure), in its bottom part with the help of the above said pin (223) through the above said slots (not shown on the figure); in the top part of the spray element there is a hollow 231 to position the thermosensitive element 232, in the sides of the spray element's top part there are at least two symmetrical spraying openings 233 (one is not shown on the figure), whereas, the locking thermosensitive element 232 forms up a retainer for the specified rod and prevents release of the spring 221, whereas destruction of the thermosensitive element 232 causes release of the spring 221; whereas, release of the spring 221 results in transition of the specified pin 223 along the specified slots (not shown on the figure) towards the locknut 210, whereas, the mentioned tubular push-bar 222 is positioned so that when rod 223 moves, the push-bar moves towards locknut 210 in order to break off the specified locking element 211 and to release the fire-extinguishing agent.

The container 10 may be a cylinder or any other container which confines the gas fire extinguishing agent. Whereas, it is preferable to ensure the volume of the container 10 being 0.08 to 0.67 l, dimensions of the container 10 constituted respectively, 210 to 440 mm in length and 35 to 60 mm in width, and the container 10 could accommodate respectively 60 to 500 g of fire-extinguishing agent. Such specifications of container 10 allow to ensure sufficient workability of the facility and safety of operation, so far as in combination with other parameters of the device, safe holding of the gas fire extinguishing agent inside container 10 is ensured. Whereas, the gas fire extinguishing agent is any gas fire extinguishing agent of the respective equipment level. Preferable, this is carbon dioxide.

Locknut 11 ensures locking of the gas fire-extinguishing agent in container 10. This also allows to carry out several transportation of container 10 and of lock and release device 20, as well to ensure assembly of the device immediately within the room being protected, which excludes the risk of accidental device actuation. Whereas, closure element 111 may be performed as, but not limited to, a metal membrane or a membrane of any other material, which is capable to resist work pressure 250 Bar under 20 degrees Celsius. Whereas, in case if the membrane is made of metal, that its thickness should be at least 0.2 mm and 1 mm maximum. It must be obvious for a specialist in this engineering sector, that if the membrane is made of another material, probably it must be of another thickness; however, it must not loose the capability to resist the specified work pressure; whereas, the push bar 222 must be able to break through such membrane.

The slots inside which pin 223 moves, are performed symmetrically to each other within walls of push-bar casing 220. This allows to position the push bar along the axis of the container's outlet 10 and excludes a possibility of its seizing-up or breaking-through the closure element 111 under angle. The length of the slots within which the pin 223 moves, the length of release of the spring 221 which ensures motion of tubular push bar 222, in preferable variant of realization, approximately corresponds to a half-length of the thermosensitive element. This allows to ensure the travel of tubular push bar 222 sufficient to reliably break through closure element 111, but at the same time not to block spraying holes 233 in the actuated state of lock and release device. Tubular push-bar 222 represents a hollow needle on the foundation which contains at least two symmetrical holes. Fastening of the spring 221 in charged state is provided for through specified holes with the help of the specified pin 223. With the help of the same pin 223, the push bar 223, casing of push bar 220 and spray element 230 are fastened with respect to each other. Whereas, section of pin 223, in the middle part, which is positioned crosswise towards the outlet in the foundation of tubular push-bar 222, is performed more narrow which allows to ensure unhampered passage of gas fire-extinguishing agent. In the spots of pin 223 connection with spray element casing 230 the pin 223 may be widen in order to provide for its best fastening. Whereas, the tip of tubular push-bar needle 222 may contain an additional side hole, which allows to speed up release of gas fire-extinguishing agent after breaking-off of the closure element 111.

Cap of spray element 230 may contain several spray holes 233. In case of making two spray holes, it is preferred to make such holes symmetrical to each other. In case of making three spray holes, it is preferred to make such holes with the angle of 120 degrees with respect to each other. In case of making four spray holes, it is preferred to make such holes with the angle of 90 degrees with respect to each other, etc. Thermosensitive element 232 may be a thermal lock, without limits. Thermal lock is a well-known device from the equipment level, which is a glass balloon with a substance. When it is heated, glass gets broken and the thermal lock is destructed. It is preferred, that in case if the thermosensitive element 323 is performed as thermal lock, temperature of its actuation varied within the range from 57 to 79+/−3 degrees Celsius. For a specialist in this engineering sector, it must be obvious that also another device may be used as the thermosensitive element, for example, a metal rod or a strip, which elasticity or brittleness is increased when heated to certain temperatures. This will also result in termination of their operation as the limit stop for spring 221. In case if the fire-extinguishing device is supplied with the forced-actuation device, one of the spray holes 233 can be attached with such forced-actuation device. Preferably, this should be a threaded connection so far as it allows to most accurately direct the forced-actuation device with respect to the thermosensitive element 232; however, any connection may be used, for example, pressure coupling.

Figure 2:
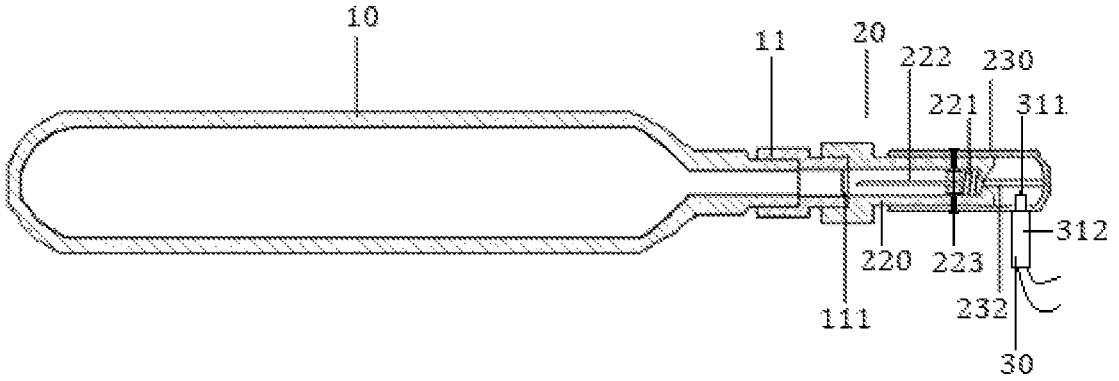
FIG. 2 demonstrates a blank drawing of the applied device for fire extinction, to which lock and release device a forced-actuation device is attached.

FIG. 2 represents a blank drawing of the claimed fire-extinguishing device, to which lock and release device a forced-actuation device 30 is attached, which includes a fixed impact rod 311 as well as an impact rod release tool 312, which is performed with the feature of connecting a sprayer 230 through sprayer opening 233, of the above described lock and release device to the lock and release device so that the impact rod 311 is directed towards the thermosensitive element 232, whereas the forced-actuation device is performed with the feature of release of the impact rod 311 after receiving the control signal from the control device. It is preferably that there is provided such positioning of the forced-actuation device 30, in which the impact rod 311 is positioned at the distance of 0 to 7 mm from the thermosensitive element.

The fire-extinguishing device in such performance may be a part of the fire-extinguishing system. Such system must contain at least a control device and a fire-extinguishing device with a forced-actuation device 30, connected with the control device. In supply of the control signal to forced-actuation device, there will be ensured release of impact rod 311 by means of release tool of impact rod 312. This may be, for example, a pyrocartridge or any other release tool which ensures sufficient impulse so that the impact rod 311 destructs the thermosensitive element 232. A specialist in this engineering sector should understand that in case of such performance, it is not obligatory to have a single electric circuit and the control signal may be transmitted with the help of wireless connection.

The fire-extinguishing device operates as follows.

The fire-extinguishing device must be placed in the room to be protected or immediately at the object to be protected, such as electric cabinet or a similar object. In case of occurrence of ignition source, the thermosensitive element 232 is heated to its actuation temperature and is destructed. Due to destruction of the thermosensitive element 232, retainer between the spring 221 and the top part of spray element 230 ceases to exist, spring 221 is released and moves the tubular push-bar 222 with tension towards the locknut 11 with the locking element 111. Tubular push-bar 222 pushes the locking element 111, due to which the gas fire-extinguishing agent through tubular push-bar 222 starts entering the casing of push-bar 220; and therefrom, through a hole in its top cone-shaped part, it penetrates into the cap of spray element 230 and further to spray holes 233. In case of forced actuation, when the fire-extinguishing device is supplied with the forced-actuation device 30, in case of detection of fire source in the room to be protected, or to prevent possible occurrence of fire source, there may be supplied a control signal to the forced-actuation device 30. It will cause actuation of the release tool impact rod 312 and location of impact rod 311 towards the thermosensitive element 232 which will also result in its destruction and further actuation of fire-extinguishing device will take place according to the above described principle.

This description for realization of the claimed invention demonstrates only certain variants for realization and does not limit other variants for realization of the claimed invention, so far as possible other alternative variants for realization of the claimed invention, which are within the volume of information as declared herein, must be obvious for a specialist in this engineering sector who possesses general qualification and to whom the claimed invention is designated.

The invention claimed is:

1. A fire-extinguishing device comprising:

a container comprising an outlet, wherein the container is filled with a gas fire-extinguishing agent a locknut connected with the outlet of the container and comprising a locking element which retains the fire-extinguishing agent inside the container under pressure; and a lock and release device comprising:

a push-bar casing, which is connected with the locknut on a first end and with a spray element on a second end, wherein the casing includes a longitudinal channel through its center and at least two symmetric longitudinal slots extending laterally from the channel to the outside surface of the casing;

a hollow tubular push-bar disposed within the channel of the casing, the push-bar including at least two symmetrical holes on the end of the push-bar furthest from the locking element of the locknut;

a pin disposed through the holes of the push-bar and through the slots of the casing, wherein the section of the pin positioned within the push-bar has significantly less width than the ends of the pin;

the spray element comprising a hollow cylindrical cap threaded onto the push-bar casing and including at least two symmetrical holes through which the pin is disposed; the spray element further comprising a hollow for placing a locking thermosensitive element in the part of the spray element furthest from the container; the spray element further comprising at least two symmetrical spray holes in the sides of the part of the spray element furthest from the container; and a spring disposed between the pin and the locking thermosensitive element; wherein the locking thermosensitive element prevents the spring from release; wherein destruction of the thermosensitive element causes the spring to release, causing the pin to move along the slots towards the locknut, in turn causing the push-bar to move towards the locknut and put pressure on the locking element, thereby releasing the fire-extinguishing agent.

2. A fire-extinguishing device comprising:

a container comprising an outlet, wherein the container is filled with a gas fire-extinguishing agent a locknut connected with the outlet of the container and comprising a locking element which retains the fire-extinguishing agent inside the container under pressure; and a lock and release device comprising:

a push-bar casing, which is connected with the locknut on a first end and with a spray element on a second end, wherein the casing includes a longitudinal channel through its center and at least two symmetric longitudinal slots extending laterally from the channel to the outside surface of the casing;

a hollow tubular push-bar disposed within the channel of the casing, the push-bar including at least two symmetrical holes on the end of the push-bar furthest from the locking element of the locknut;

a pin disposed through the holes of the push-bar and through the slots of the casing, wherein the section of the pin positioned within the push-bar has significantly less width than the ends of the pin;

the spray element comprising a hollow cylindrical cap threaded onto the push-bar casing and including at least two symmetrical holes through which the pin is disposed; the spray element further comprising a hollow for placing a locking thermosensitive element in the part of the spray element furthest from the container; the spray element further comprising at least two symmetrical spray holes in the sides of the part of the spray element furthest from the container; one of the spray holes being configured to connect a forced-actuation device; and a spring disposed between the pin and the locking thermosensitive element; wherein the locking thermosensitive element prevents the spring from release; wherein destruction of the thermosensitive element causes the spring to release, causing the pin to move along the slots towards the locknut, in turn causing the push-bar to move towards the locknut and put pressure on the locking element, thereby releasing the fire-extinguishing agent.

3. A lock and release device for use with a fire-extinguishing device comprising a container filled with a fire-extinguishing agent, and a locknut with a locking element, the lock and release device comprising:

a push-bar casing, which is connected with the locknut on a first end and with a spray element on a second end, wherein the casing includes a longitudinal channel through its center and at least two symmetric longitudinal slots extending laterally from the channel to the outside surface of the casing;

a hollow tubular push-bar disposed within the channel of the casing, the push-bar including at least two symmetrical holes on the end of the push-bar furthest from the locking element of the locknut;

a pin disposed through the holes of the push-bar and through the slots of the casing, wherein the section of the pin positioned within the push-bar has significantly less width than the ends of the pin;

the spray element comprising a hollow cylindrical cap threaded onto the push-bar casing and including at least two symmetrical holes through which the pin is disposed; the spray element further comprising a hollow for placing a locking thermosensitive element in the part of the spray element furthest from the container; the spray element further comprising at least two symmetrical spray holes in the sides of the part of the spray element furthest from the container; and a spring disposed between the pin and the locking thermosensitive element; wherein the locking thermosensitive element prevents the spring from release; wherein destruction of the thermosensitive element causes the spring to release, causing the pin to move along the slots towards the locknut, in turn causing the push-bar to move towards the locknut and put pressure on the locking element, thereby releasing the fire-extinguishing agent.

4. A lock and release device for use with a fire-extinguishing device comprising a container filled with a fire-extinguishing agent, and a locknut with a locking element, the lock and release device comprising:

a push-bar casing, which is connected with the locknut on a first end and with a spray element on a second end, wherein the casing includes a longitudinal channel through its center and at least two symmetric longitudinal slots extending laterally from the channel to the outside surface of the casing;

a hollow tubular push-bar disposed within the channel of the casing, the push-bar including at least two symmetrical holes on the end of the push-bar furthest from the locking element of the locknut;

a pin disposed through the holes of the push-bar and through the slots of the casing, wherein the section of the pin positioned within the push-bar has significantly less width than the ends of the pin;

the spray element comprising a hollow cylindrical cap threaded onto the push-bar casing and including at least two symmetrical holes through which the pin is disposed; the spray element further comprising a hollow for placing a locking thermosensitive element in the part of the spray element furthest from the container; the spray element further comprising at least two symmetrical spray holes in the sides of the part of the spray element furthest from the container; one of the spray holes being configured to connect a forced-actuation device; and a spring disposed between the pin and the locking thermosensitive element; wherein the locking thermosensitive element prevents the spring from release; wherein destruction of the thermosensitive element causes the spring to release, causing the pin to move along the slots towards the locknut, in turn causing the push-bar to move towards the locknut and put pressure on the locking element, thereby releasing the fire-extinguishing agent.

5. The device according to any of claims 1 and 3, where the length of the slots is less than the length of the locking thermosensitive element.

6. The device according to claim 5 where the end of the push-bar closest to the locking element of the locknut comprises a needle, and wherein the tip of the needle of the tubular push-bar includes a side hole.

7. The device according to claim 5 where the thermosensitive element is a thermal lock.

8. The device according to claim 7 where the thermal lock has an actuation temperature of 57 to 79+/−3 degrees of Celsius.

9. The device according to claim 5 where the locking element is a metal membrane.

10. The device according to claim 9, where the metal membrane has a thickness between 0.2 mm and 1 mm.

11. The device according to claim 5 where the container volume ranges from 0.08 to 0.671.

12. The device according to claim 5 where the quantity of fire-extinguishing agent in the container ranges from 60 to 500 g.

13. The device according to claim 5 where the container's length ranges from 210 to 440 mm and width from 35 to 60 mm.

14. The device according to claim 5 where the spray element comprises three spray holes which are positioned 120 degrees from each other.

15. The device according to claim 5 where the spray element comprises four spray holes which are positioned 90 degrees from each other.

16. The device according to any of claims 2 and 4, further comprising a forced-actuation device comprising a fastened impact rod and a release tool for the impact rod, wherein the forced-actuation device is connectable with one of the spray holes of the spray element of the lock and release device so that the impact rod is directed towards the thermosensitive element, wherein the forced-actuation device is configured to release the impact rod after receiving a control signal from a control device.

17. The device according to claim 16 wherein the impact rod is positioned at the distance of 0 to 7 mm from the thermosensitive element.

18. The device according to claim 17, wherein the control device is configured to send the control signal to the forced-actuation device when a fire source is detected.

* * * * *